US006365859B1

(12) United States Patent
Yi et al.

(10) Patent No.: US 6,365,859 B1
(45) Date of Patent: Apr. 2, 2002

(54) PROCESSOR IC PERFORMANCE METRIC

(75) Inventors: John Yi; Terry Marquis, both of Austin, TX (US)

(73) Assignee: Advanced Micro Devices, Austin, TX (US)

( * ) Notice: Subject to any disclaimer, the term of this patent is extended or adjusted under 35 U.S.C. 154(b) by 0 days.

(21) Appl. No.: 09/605,592

(22) Filed: Jun. 28, 2000

(51) Int. Cl.[7] ..... B07C 5/344
(52) U.S. Cl. ..... 209/573; 324/158.1
(58) Field of Search ..... 209/573, 936, 209/571, 556; 324/158.1

(56) References Cited

U.S. PATENT DOCUMENTS 4,084,131 A * 4/1978 Matthey ..... 324/56
4,639,664 A * 1/1987 Chiu et al. ..... 324/73
4,698,587 A * 10/1987 Burns et al. ..... 324/73
5,513,152 A * 4/1996 Cabaniss ..... 368/118
5,516,024 A * 5/1996 Rasp et al. ..... 228/104
5,543,727 A * 8/1996 Bushard et al. ..... 324/760
5,574,853 A * 11/1996 Barch et al. ..... 395/183.06
5,592,496 A * 1/1997 Shimizu et al. ..... 371/27
5,625,288 A * 4/1997 Snyder et al. ..... 324/158.1
5,952,821 A * 9/1999 Gillette ..... 324/158.1
6,005,408 A * 12/1999 Gillette
6,140,832 A * 10/2000 Vu et al. ..... 324/765
6,175,246 B1 * 1/2001 Statovici et al. ..... 324/765
6,192,495 B1 * 2/2001 Totorica et al. ..... 714/718
6,313,652 B1 * 11/2001 Maeng ..... 324/760
6,326,800 B1 * 12/2001 Kirihata ..... 324/760

* cited by examiner

*Primary Examiner*—Donald P. Walsh
*Assistant Examiner*—Daniel K Schlak
(74) *Attorney, Agent, or Firm*—Kelly K. Kordzik; Winstead Sechrest & Minick P.C.

(57) ABSTRACT

Parametric test data is taken on a sampled set of a particular integrated circuit (IC) using both an Automatic Test Equipment (ATE) tester and a system test motherboard. The parametric test data comprises maximum operating frequency, maximum operating temperature and minimum operating power supply voltage. A maximum operating frequency is determined at a particular fixed operating temperature and power supply voltage. A maximum operating temperature is determined at a particular fixed operating frequency and power supply voltage. Finally, a minimum operating power supply voltage is determined at a particular fixed operating frequency and temperature. Multiple two parameter graphs are plotted and the slope or numerical derivative for each plot is calculated as conversion factors. During a normal production run for the particular IC performance limit data is taken on the ATE tester comprising the same three parameters of maximum operating frequency at a particular temperature and power supply voltage. The calculated conversion factors are used to scale the production parametric data from the ATE tester to new calculated expected performance limits. These new performance limits are used to sort production ICs into system performance classes for which the ICs are expected to qualify.

5 Claims, 3 Drawing Sheets

| | Voltage | Frequency | Temperature |
|---|---|---|---|
| Tester Conditions | Variable X | Fixed | Fixed |
| PC Conditions | Fixed | Fixed | Variable Y |

MICROPROCESSOR PERFORMANCE PARAMETERS

Class performance yield model for a given package and fab process target

PROCESSOR IC PERFORMANCE METRIC

TECHNICAL FIELD

The present invention relates in general to testing an integrated circuit (IC) or processor chip using the system board for a PC or a workstation and an Automatic Test Equipment (ATE) tester.

BACKGROUND INFORMATION

ICs and in particular processor ICs are produced in very high volume. Many processors have a maximum operating frequency as one of the key parameters for assessing the processor's performance and therefore its price point. Processors, which are manufactured in a complementary metal oxide silicon (CMOS) topology, have a maximum operating frequency that is dependent on power supply voltage, operating temperature, packaging method and the system environment in which it is used. Most processor ICs are specified with a maximum operating frequency at a maximum operating temperature and a minimum power supply voltage. Of course users of the processors expect that the performance is guaranteed in a system environment comprising a system mother board, system power supply and corresponding operating environment with its noise levels and other system variables. Automatic Test Equipment (ATE) systems are manufactured to aid the IC vendors in testing large numbers of ICs. These ATE systems are characterized by their ability to be adjusted for a variety of ICs, thus they have the ability to vary parameters important to an IC's operation. These ATE systems, however, do not replicate a system operation environment and in fact may produce a more ideal environment, for example lower noise, better clock signals, and better power supply regulation. These ATE systems, however, are designed to test a high volume of ICs and to provide flexibility in programming test variables. Because of this there is a need for a method that allows ATE test system variables to be set that will correlate closely with corresponding desired system operation limits so high volume testing will allow ICs to be more accurately sorted into system operation classes.

SUMMARY OF THE INVENTION

Test data is acquired on a set of ICs using both an ATE test system and a system test motherboard. The data acquired on the ATE is different from the data acquired on the system test motherboard. Three key parameters, operating frequency, operating temperature, and operating power supply voltage, are used to create sets of parametric data for each IC in a sampled set of ICs. During a test only one parameter is varied and the other two are held fixed; the variable parameter is adjusted until the IC fails. Multiple two parameter graphs of the parametric data for the sample set of ICs are plotted using one parameter from the ATE tester and another from the system test motherboard. The slope or numerical derivative is calculated to generate conversion factors. During a manufacturing cycle, all the production ICs are tested on the ATE tester as part of the production test to determine a single operational parameter limit with the two other parameters held fixed. The conversion factors are then used to normalize the production test data enabling the production ICs to be sorted into different operational classes or bins. These operating classes may be at a different frequency, temperature and voltage from the test points used in the actual ATE production tests.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
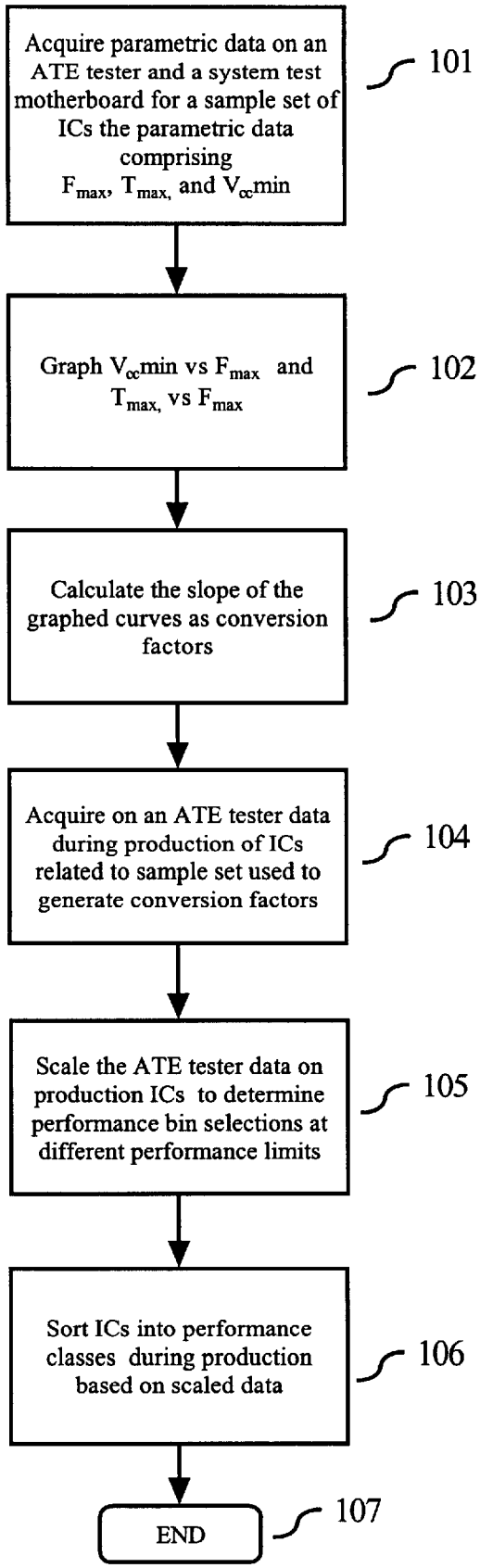
FIG. 1 is a graph of parametric data according to embodiments of the present invention.

In the following description, numerous specific details are set forth to provide a thorough understanding of the present invention. However, it will be obvious to those skilled in the art that the present invention may be practiced without such specific details. For the most part, details may have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

In embodiments of the present invention parametric test data is taken using an ATE tester and using a system test motherboard. The tests are used to generate test data to determine an IC's maximum operating frequency, maximum operating temperature and minimum operating voltage. In determining the maximum operating frequency, the case temperature of the IC and its power supply voltage are held fixed. It is known in the prior art that these three parameters are interdependent. For example, the maximum operating frequency is dependent on temperature, however, embodiments of the present invention are not used to determine the variability of the maximum operating frequency with temperature (e.g., case temperature), rather the maximum operating frequency is determined at a fixed frequency and power supply voltage.

Figures 2A, 2B:
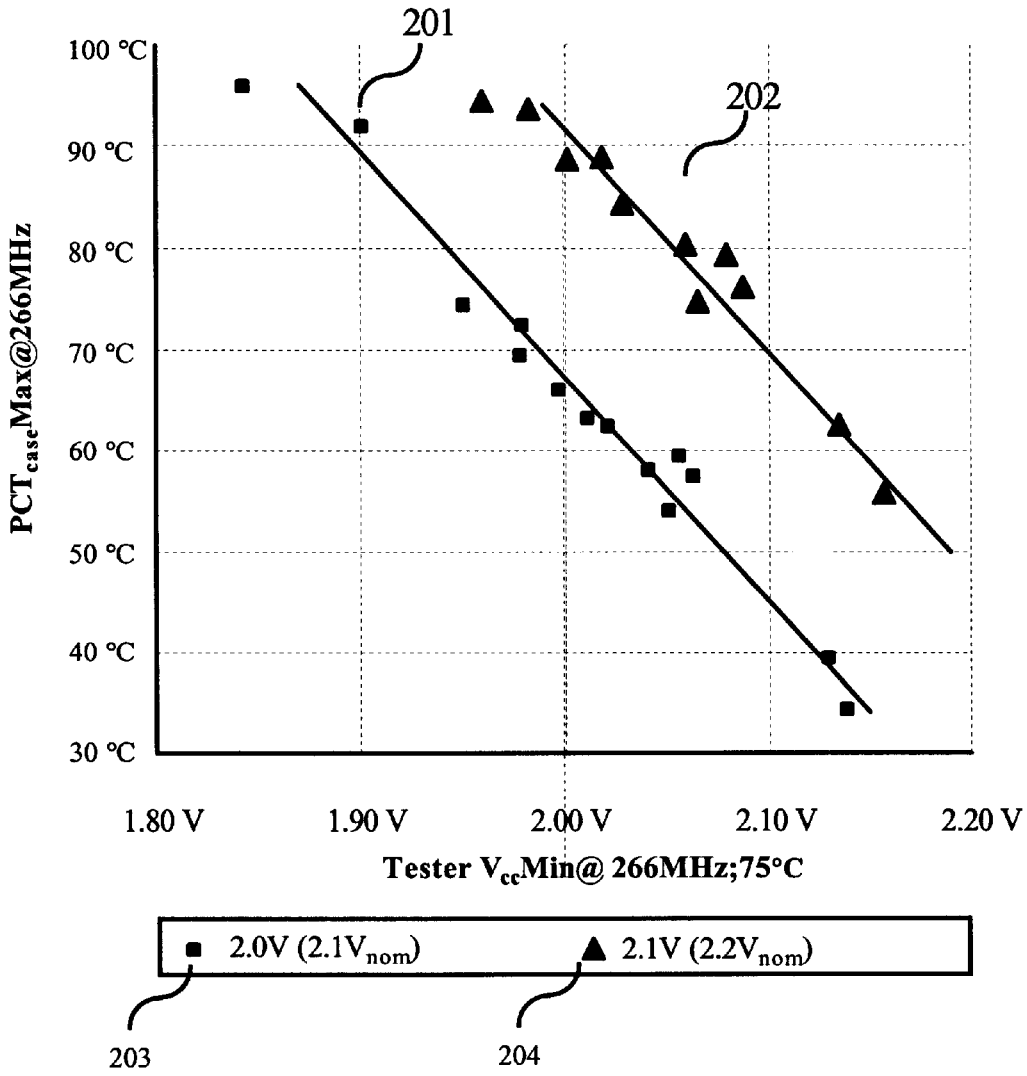
FIGS. 2A and 2B illustrate a graph of parametric data with test conditions.

FIG. 2A illustrates performance parameters and conditions for the data used to create the graphs in FIG. 2B. "PC Conditions" refer to the system test motherboard, and the "Tester Conditions" refer to the ATE tester. FIG. 2B illustrates best fit lines through sets of exemplary discrete data points. A point on a graph (e.g., 201) indicates that a specific processor chip operating at 266 MHz in the PC Condition (system test motherboard) failed at a case temperature of 92° C., and the same processor at 266 MHz and 75° C. had a minimum operating power supply voltage (Vcc) of 1.9 Volts. The legend 203 indicates that the PC data (points indicated by ■) was taken at a nominal (nom) supply voltage of 2.0 Volts, and the legend 204 indicates that the PC data points indicated by ▲) was taken at a nominal supply voltage of 2.1 Volts.

Certain of the parametric tests are easier to run on an ATE tester and others are easier to run on a system test motherboard. One could exhaustively test all parameter variations to determine the correlation between the ATE tester and the system test motherboard. However, embodiments of the present invention take a novel approach to correlating performance on an ATE tester to expected performance on a system motherboard. In embodiments of the present invention, it is easier to determine maximum operating frequency at a nominal temperature and power supply voltage on an ATE tester while it is correspondingly easier to determine maximum operating temperature at a nominal frequency and power supply voltage on a system test motherboard. Because a particular IC is tested on both the ATE and the system test motherboard, sets of two parameter graphs may be plotted (refer to FIG. 2B). For example, parameter A (ATE tester parameter) and parameter B (system test motherboard parameter) are plotted as a point on a two dimensional graph for an exemplary IC. If N ICs were tested in the sample set, then the graph would have N points (one point for each IC). The slope of this graph is calculated (e.g., Δ parameter A/Δ parameter B) as a conversion factor. Since there are only three varied parameters then only two independent conversion factors are determined. A third conversion factor may be calculated from the two independent ones.

In embodiments of the present invention, a conversion factor representing the change in maximum operating temperature on the system motherboard versus the change in maximum operating frequency on the ATE tester is determined (° C./MHz). Another conversion factor, the change in minimum operating voltage on the ATE tester versus the change in maximum operating frequency on the ATE tester is determined (mv/MHz). The ratio of these two conversion factors may likewise be calculated to generate a third conversion factor (mv/° C.) if needed. It has been determined that a strong correlation is expected between one IC performance parameter taken on the ATE tester and another performance parameter taken on a system test motherboard.

While manufacturing an IC (with calculated conversions factors) another set of parametric data is taken using the ATE tester. An IC (e.g., a processor IC) may be used in several system types with different operating environments within each system type. Different performance parameters could be determined by running many different ATE tests on an IC to determine its performance limit in each possible environment. In embodiments of the present invention, a single performance limit parameter (e.g., the maximum operating frequency) is obtained at a fixed temperature and power voltage. Previously determined conversion factors are then employed to scale the particular test result for an IC. Scaling the IC performance parameter is used to determine the performance classes for which the IC qualifies. For example, a particular IC may be tested to determine a maximum operating frequency at a particular temperature and power supply voltage. Because different products, for example, servers, PCs and lab tops, may have different operating environments, it would be desirable to know the tested IC's expected maximum frequency at another operating point without having to retest the part. Using the conversion factors in embodiments of the present invention, the IC's expected maximum operating frequency at the new conditions may be calculated instead of having to retest.

Figure 3:
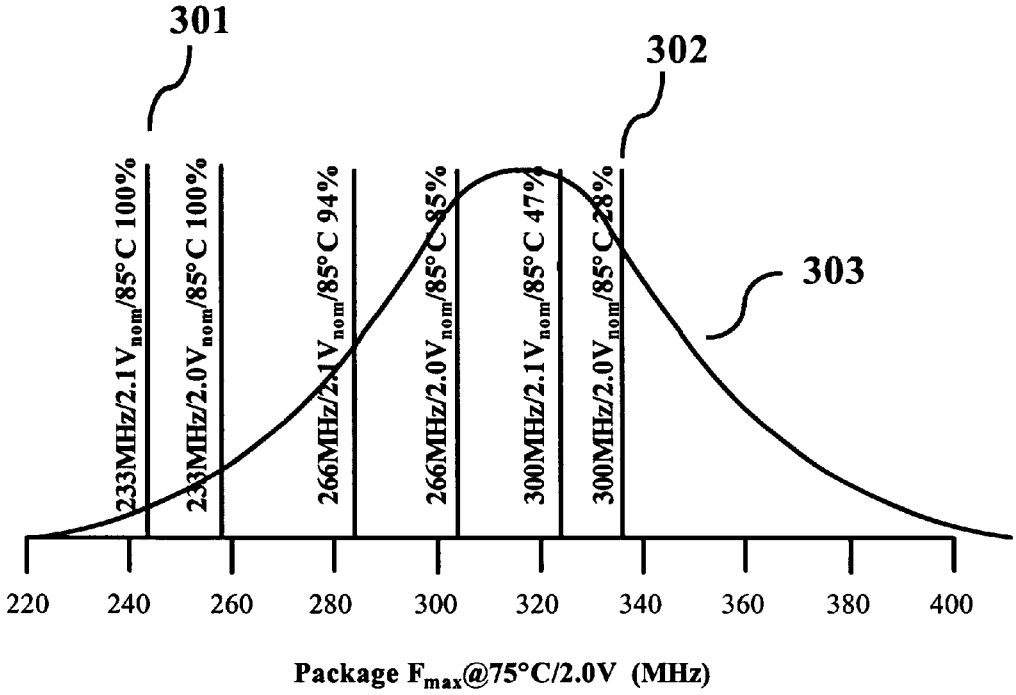
FIG. 3 is a graph of performance partitions relative to a distribution of processors versus maximum operation frequencies.

FIG. 3 illustrates projections of expected performance using embodiments of the present invention. A particular set of ICs were tested and conversion factors were used to create the performance partitions shown (e.g., 301). When the performance data taken on the production run of ICs is scaled using conversion factors in embodiments of the present invention, a number performance classifications may be determined. The vertical lines indicate what percentages of the ICs qualify for performance different bins. Line 301, for example, indicates that 100% of the ICs (FIG. 3 data) tested would meet a 233 MHz operating frequency at a power supply voltage of 2.1 Volts and a temperature of 85° C. Line 302, on the other hand, indicates that only 28% of the same tested ICs would meet a 300 MHz operating frequency at a power supply voltage of 2.0 Volts and a temperature of 85° C. Curve 303 is an overlaid curve that illustrates an expected performance distribution based on a Gaussian distribution curve.

FIG. 1 illustrates method steps in embodiments of the present invention. In step 101, parametric data is acquired on an ATE tester and a system test motherboard (PC Conditions). The parametric data comprises maximum operating frequency ($F_{max}$), maximum operating temperature ($T_{max}$), and minimum power supply voltage ($V_{cc}$min). In step 102, the parameters are graphed (ordered) and in step 103 the slope of the best fit curve is calculated to create conversion factors. In step 104, ATE data is acquired on production ICs related to the calculated conversion factors. In step 105, the ATE production test data is scaled using the conversion factors to determine performance bin selections using different performance categories. In step 106, ICs are sorted into performance bins based on scaled data. Step 107 ends the production run and IC classification.

Although the present invention and its advantages have been described in detail, it should be understood that various changes, substitutions and alterations can be made herein without departing from the spirit and scope of the invention as defined by the appended claims.

What is claimed is:

1. A method of sorting integrated circuits (ICs) into performance classes comprising the steps of:

acquiring for each IC in a sampled set of ICs measured parameters, said measured parameters comprising:

a first parameter comprising a first maximum operating frequency at a first voltage and a first temperature;

a second parameter comprising a first maximum operating temperature at said first voltage and a first frequency; and a third parameter comprising a first minimum operating voltage at said first temperature and said first frequency;

graphing a first function comprising said first parameter versus said third parameter for each of said sampled set of ICs and calculating a corresponding first factor as a slope (numerical derivative) of said first function;

graphing a second function, said second function comprising said second parameter versus said third parameter and calculating a corresponding second factor as a slope (numerical derivative) of said second function;

acquiring for a production set of ICs a first production parameter comprising a second maximum operating frequency at a second voltage and a second temperature;

adjusting said first production parameter using said first factor, said second factor or a combination of said first and second factors to a second production parameter, said second production parameter comprising a third maximum operating frequency at a third voltage and a third temperature; and partitioning said production set of ICs into performance classes based on said second production parameter, wherein said performance classes represent expected performance limits in an operating system environment for said ICs.

2. The method of claim 1, wherein said IC is a microprocessor.

3. The method of claim 1, wherein said performance classes are expected maximum operating frequency in the operating system environment.

4. The method of claim 1, wherein at least one of said first, second or third parameter is acquired on the operating system environment and at least one of said first, second or third parameter is acquired on a tester environment.

5. The method of claim 1, wherein said combination of said first and second factors used to adjust said first production parameter comprises multiplying or dividing said first and second factors.

* * * * *

UNITED STATES PATENT AND TRADEMARK OFFICE

CERTIFICATE OF CORRECTION

PATENT NO. : 6,365,859 B1
DATED : April 2, 2002
INVENTOR(S) : Yi et al.

It is certified that error appears in the above-identified patent and that said Letters Patent is hereby corrected as shown below:

Title page,
Item [*], Notice, delete the phrase "by 0 days" and insert -- by 115 days --

Signed and Sealed this

Twenty-first Day of September, 2004

JON W. DUDAS
*Director of the United States Patent and Trademark Office*